US006139165A

United States Patent [19]

Crowe

[11] Patent Number: 6,139,165

[45] Date of Patent: Oct. 31, 2000

[54] COMBINATION FLASHLIGHT OR NIGHTSTICK/BATON RESCUE PUNCH ASSEMBLY

[76] Inventor: Robert E. Crowe, 624 Union La., Brielle, N.J. 08730

[21] Appl. No.: 09/302,503

[22] Filed: Apr. 30, 1999

[51] Int. Cl.[7] ..... A45B 3/02

[52] U.S. Cl. ..... 362/102; 362/208; 362/206; 273/84 R; 273/67 R

[58] Field of Search ..... 362/102, 253, 362/208, 206, 205; 273/84 R, 67 R

[56] References Cited

U.S. PATENT DOCUMENTS 5,329,685 7/1994 Gillespie ..... 29/254
5,363,285 11/1994 Wideman ..... 362/102
5,509,653 4/1996 Parsons ..... 273/84 R
6,010,508 1/2000 Bradley ..... 606/86

*Primary Examiner*—Alan Cariaso
*Assistant Examiner*—Ronald E. DelGizzi
*Attorney, Agent, or Firm*—Clifford G. Frayne

[57] ABSTRACT

A flashlight or nightstick/baton assembly in which the end cap of the assembly has been removed and replaced with a punch assembly having a threaded base replacing the end cap and a head cap secured to the base and slidably moveable with respect to the base, the head cap enclosing a biasing means and a punch means, the punch means being receptive and reactive to the slidable movement of the head cap in relationship to the base for engagement with tempered glass and automatically resetting after such engagement.

2 Claims, 2 Drawing Sheets

110
112
114
34
100
116

34
30
22
24
26
11
32
28
20
20
10
12
16
18
14

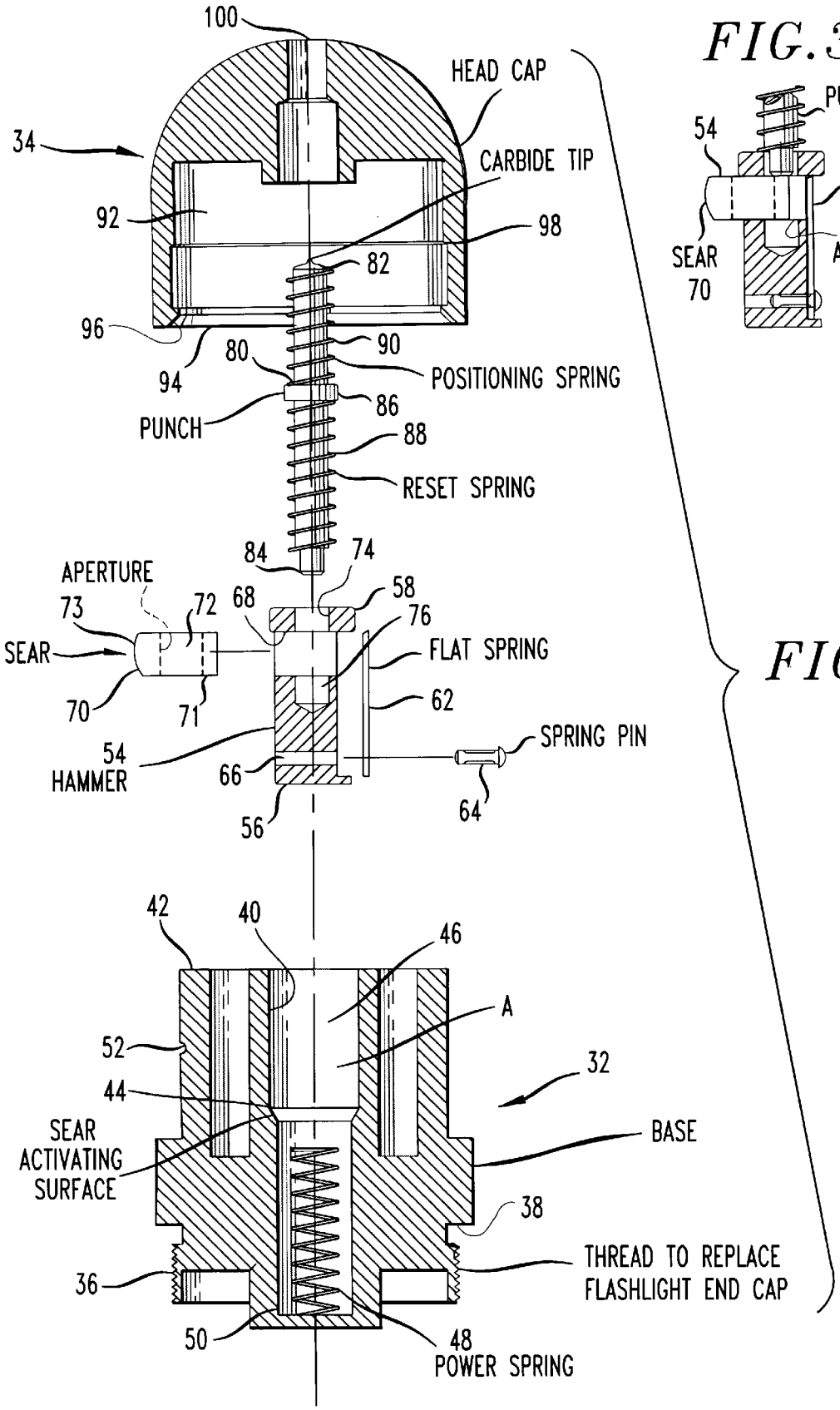
FIG. 2
FIG. 3
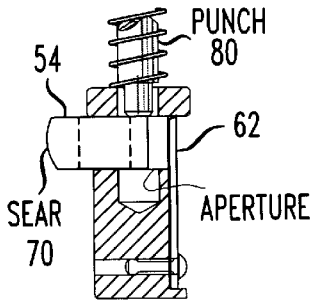

COMBINATION FLASHLIGHT OR NIGHTSTICK/BATON RESCUE PUNCH ASSEMBLY

BACKGROUND OF THE INVENTION

1. Field of the Invention

The present invention relates to a rescue apparatus and, in particular, a tempered impact punch to aid law enforcement, fire departments, and first aid officials in shattering tempered glass from an automobile in order to rescue the occupants combined in a flashlight or nightstick.

2. Background of the Invention

Law enforcement, fire department, and first aid personnel, such as emergency squad members, are many times faced with a situation in which an individual or occupant of an automobile is trapped within the automobile and the only manner in which the individual or occupant can be removed is to shatter the tempered glass of the side, rear or wing windows of the automobile. The breaking of tempered glass windows is not as easily accomplished as one might think. Further, situations in which the vehicle is found can further complicate the ability to shatter the window and rescue the occupant. For example, oftentimes, the automobile will be partially or fully submerged and it would be extremely difficult for an individual to shatter the window with a nightstick, tire iron or the like while standing chest-high in water or below the surface. Further, even standing on dry land, it is not always an easily accomplished task. Still further, when using a mechanical device to shatter the tempered glass of the vehicle, by utilizing a stance in which the individual swings a heavy, hard object against the tempered glass window, shattering does take place, with the shattered tempered glass spraying inwardly, and the hard object continuing into the confines of the vehicle, thus presenting potential harm or further injury to the occupants. Further, the rescuer's hand is in close proximity to the broken glass and most times will suffer cut skin.

Tempered glass is most effectively broken or shattered when it is subjected to a pin point force. In the machinist and mechanic's trade, there are spring-loaded punches utilized by machinists and mechanics to mark pieces of steel or metal for drilling. These types of punches would be suitable for shattering tempered glass in the situations enumerated above. However, these punches are the size of a pencil or pen. They are oftentimes misplaced or mislaid and are not readily available in an emergency situation when seconds count. Applicant has developed a punch assembly which replaces the end cap on a standard policemen, firemen, or emergency squad members flashlight or can be incorporated in the end of a nightstick/baton. In law enforcement vehicles and emergency vehicles, such as emergency squad vehicles and fire trucks, a flashlight or a nightstick/baton is a necessary tool and is normally located in a designated location in the vehicle and constitutes a check-off item by the officer or squad member utilizing the vehicle on their shift. In other words, the flashlight or nightstick/baton must be accounted for at the beginning and/or end of the shift. As such, the operator of the vehicle knows the exact location of the flashlight or nightstick/baton in case it is needed in an emergency. By combining a punch assembly with the flashlight or nightstick/baton, the law enforcement officer or rescue squad officer would now automatically know the location of a device which could be utilized in shattering the tempered glass of an automobile in order to immediately provide aid to the occupants.

Applicant's apparatus replaces the end cap of the flashlight with an assembly which maintains the necessary contact on the batteries of the flashlight for operation of the flashlight, yet provides a novel mechanical assembly which the user may utilize by reversing the end of the flashlight and placing it against the tempered glass to be shattered and pressing inward or forward as will be explained in detail in the specification hereafter. It can also be incorporated onto one end of a nightstick/baton.

OBJECTS OF THE INVENTION

An object of the present invention is to provide for a novel assembly permitting the shattering of tempered glass in order to rescue the occupants of a motor vehicle.

A still further object of the present invention is to provide for a novel assembly which can be combined with a standard flashlight assembly.

A still further object of the present invention is to provide for a novel assembly which replaces the end cap of a standard flashlight and provides sufficient pressure on the battery pack of the flashlight to permit use of the flashlight while at the same time permitting the use of the punch assembly for the shattering of tempered glass.

A still further object of the present invention is to provide a novel assembly incorporated in the end of a nightstick/baton for shattering tempered glass.

A still further object of the present invention is to combine a novel assembly with a standard piece of rescue equipment to ensure the location of the assembly within the law enforcement, fire, or rescue vehicle.

SUMMARY OF THE INVENTION

A flashlight assembly in which the end cap has been replaced by an assembly, the assembly having a threaded base replacing the end cap of the flashlight and a head cap secured to said base and slidably movable with respect to said base and said head cap enclosing a biasing means and punch means, the punch means being receptive and reactive to the slidable movement of the head cap in relationship to the base.

BRIEF DESCRIPTION OF THE DRAWINGS

These and other objects of the present invention will become evident, particularly when taken in light of the following illustrations wherein:

FIG. 2 is an exploded view of the punch apparatus with relationship to the handle end of a flashlight; and FIG. 3 is a partial side view of the punch and sear apparatus.

DETAILED DESCRIPTION OF THE DRAWINGS

Figures 1, 4:
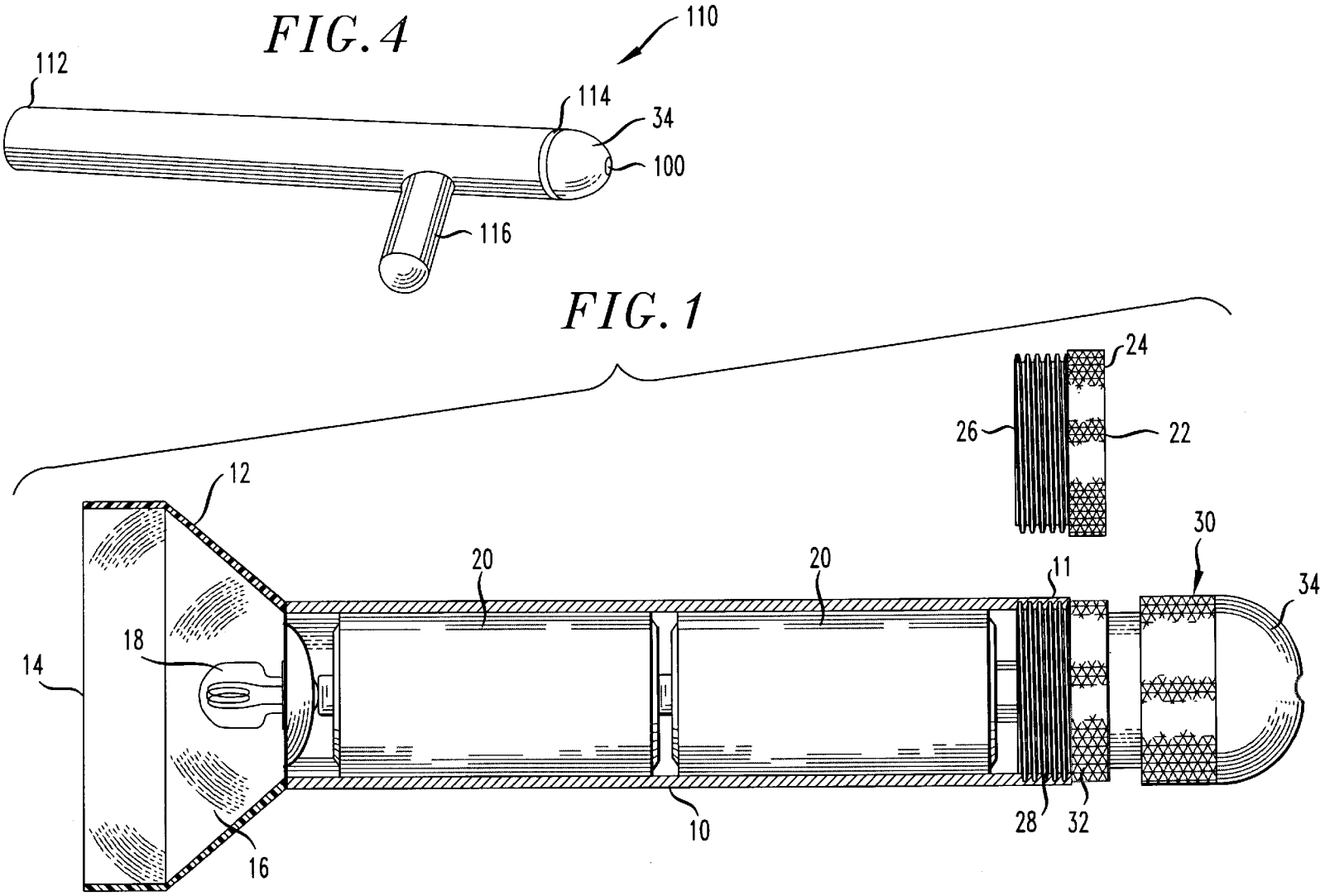
FIG. 1 is a side view of a flashlight having the punch apparatus secured thereto.
FIG. 4 is a side view of a nightstick/baton incorporating the punch assembly.

FIG. 1 is a side partial cutaway view of a flashlight having the rescue punch secured thereto. The flashlight would be a standard emergency, fire, or law enforcement flashlight having an elongate body 10, having a first end 12 which would have lens 14 and enclosed chamber 16 housing an illumination means 18. Secured within elongate body 10 would be a power source or a plurality of power sources 20 which would be standard flashlight batteries of appropriate size. Removable end cap 22, shown removed from the flashlight, would have a blunt end member 24 and a threaded securing member 26, such that when the end cap 22 was secured to second end 11 of elongate body 10 by means of internal threads 28 on the second end of the elongate body 10, the end cap would put pressure on the power source 20 to ensure contact with the illumination means 18.

Applicant's invention removes the standard end cap and replaces it with an end cap 30 having a first body member 32 which is threaded to be secured to internal threads 28 on elongate body of the flashlight and to maintain the appropriate pressure on the power source 20 to ensure contact with illumination means 18. The second body member 34 of end cap 30 snap fits to body member 32. Together, body members 32 and 34 of end cap 30 house internally, a reciprocal punch means which is illustrated in more detail in FIG. 2.

Referring to FIG. 2, there is shown an exploded view of end cap 30 illustrating first body member 32 and second body member 34. Referring to first body member 32, it can be seen that it has external threads 36 for engaging the internal threads 28 of elongate body member 10. When threaded into position, annular flange 38 is flush with second end 11 of elongate body 10 of the flashlight.

Body member 32 has an axial bore 40 extending downwardly from top end 42. Axial bore 40 has a sear actuating surface 44 which defines axial bore 40 into a larger circumference upper bore 46 and a lower smaller circumference bore 48. There would be positioned within axial bore 40, in the lower, smaller circumference portion 48, a biasing means in the form of a power spring 50.

An annular indent 52 would circumscribe first body member 32 and cooperate with second body member 34 to secure, in a snap-fit manner, second body member 34 to first body member 32.

The next element of the rescue punch as shown in FIG. 2 would be a hammer assembly. The hammer assembly would comprise a hammer 54 which would have a circular lower end 56 conforming to the circumference of the lower portion 48 of axial bore 40 and a circular upper end 58 conforming to the circumference of upper portion 46 of axial bore 40. The body of hammer 54 would be generally cylindrical with a portion of one side 60, flattened to accommodate the positioning of a flat spring 62 between lower end 56 and upper end 58. Flat spring 62 is held in position by a spring pin 64 secured in a transverse bore 66 in hammer 54. A second transverse bore 68 passes through hammer 54 proximate to upper end 58 for accommodation of sear 70. Sear 70 has a vertical aperture 72 therein, alignable with a vertical aperture 74 extending through upper end 58 of hammer 54 into transverse bore 68. Sear 70 has a flat first end 71 for contact with flat spring 62 and an angled second end 73 cooperative with sear actuating surface 44 in axial bore 40 as described hereafter. In a normal situation when the rescue punch is in an unoperative mode, aperture 74, aperture 72, and a recess bore 76, extending downwardly from transverse bore 68 in hammer 54, would not be in alignment and end 71 of sear 70 would be in contact with flat spring 62.

The next element of the rescue punch would be punch element 80 which is generally cylindrical in shape, having a first upper end 82 comprising a carbide tip for engagement with the tempered glass, and a second lower end 84 cooperative with sear 70 as described hereafter. An annular flange 86 is positioned on punch 80 at its approximate midsection and a reset spring 88 is positioned on punch 80 below annular flange 86 and a positioning spring 90 is positioned on punch 80 above annular flange 86.

The last element of the rescue punch assembly is second body member 34, which has a dome shape, having an inner cavity 92, a lower opening 94 and an annular finger flange 96. Second body member 34 is designed to slide over first body member 32, such that finger flange 96 engages annular indent 52 on first body member 32 and in this position, upper end 42 of first body member 32 will engage internal flange 98 within cavity 92 of second body member 34. An aperture 100 extends between the upper dome surface of second body member 34 axially vertically downwardly into cavity 92.

In the assembled mode, hammer 54 would rest in axial bore 40 above power spring 50. Flat spring 62 would be flush against end 71 of sear 70, such that end 73 of sear 70 would extend outwardly from the body of hammer 54. Lower end 84 of punch 80 would rest on sear 70 proximate to end 71. Second body member 34 would be secured over the punch 80 and secured to first body member 32, such that upper end 82 of punch 80 would be slightly recessed in aperture 100 of second body member 34.

The relationship between punch 80 and sear 70, in this position, can best be seen from FIG. 3, which is a partial view showing the relationship of lower end 84 of punch 80 with sear 70 and hammer 54.

In actual operation, when it is necessary to shatter tempered glass in order to gain emergency entry to a vehicle, the individual would hold the flashlight such that second body member 34 would be in communication with the tempered glass tangentially with the dome of second body member 34 proximate aperture 100. The individual would then press the flashlight against the tempered glass. This would compress second body member 34 rearwardly. In doing so, the following would happen. Punch 80 and hammer 54 would be moved rearwardly against power spring 50 compressing power spring 50. This would continue to occur until sear 70, and more particularly, end 73 of sear 70 came into communication with sear actuating surface 44, which would displace sear 70 against flat spring 62 and bring aperture 72 into alignment with aperture 74, thereby dislodging lower end 84 of punch 80. The downward force of hammer 54 and power spring 50 was caused by end 84 resting on sear 70. Now that this downward pressure is released, power spring 50 causes hammer 54 to move upwardly, imparting force onto punch 80 and extending upper end 82 of punch 80 out of aperture 100. The distance of protrusion of upper end 82 of punch 80 is only a fraction of an inch, but the force imparted to punch 80 is sufficient for upper end 80 to make a single point contact with the tempered glass and cause it to shatter instantly and fall downwardly under the influence of gravity.

Immediately upon breakage of the tempered glass, the force against the dome of second body member 34 is released, and second body member 34 moves away from first body member 32, but is limited in its range of motion by the cooperation between flange 96 and circumferential end 52. Simultaneously, flat spring 62 would move sear 70 to its unloaded position and reset spring 88 and positioning spring 90 would reposition punch 80 in its unloaded relationship with sear 70 and slightly recessed in aperture 100 from the dome portion of second body member 34.

FIG. 4 is a side view of a typical nightstick/baton 110 which may be carried by a police patrolman. The nightstick/baton is elongate in shape having a first end 112, a second end 114 and a substantially perpendicular handle member 116 positioned midway between first end 112 and second end 114. With very little modification, the punch assembly of the present invention could be incorporated into the nightstick/baton 110 either at second end 114 or at handle end 116. A threaded recess could be made in second end 114 or handle end 116 for the threaded receipt of the punch assembly as illustrated in FIG. 2 or handle end 116 and second end 114 could be fabricated with external threads and the punch assembly of present invention as illustrated in FIG. 2 could be formed with internal threads in order to secure same to nightstick/baton 110. Still further, any other suitable means of attachment may be used as long as the integrity of the nightstick/baton and the punch assembly are not compromised.

While the present invention has been disclosed with respect to the exemplary embodiment thereof, it will be recognized by those of ordinary skill in the art that many changes may be made without departing from the spirit and the scope of the invention. Therefore it is manifestly intended that the invention be limited only by the claims and the equivalence thereof.

What is claimed is:

1. A combination flashlight rescue punch comprising a standard emergency or law enforcement flashlight having an elongate body enclosing a power source, having a first end having a lens means and illumination means, and a second end, said second end comprising an end cap having a rescue punch incorporated therein, said end cap and rescue punch comprising:

a base member threadedly engageably secured to said second end of said flashlight maintaining pressure on said power source, said base member having an axial bore for receipt of a power spring compressibly positioned within said axial bore, a hammer element positionable above said power spring, said hammer element having a transverse bore for receipt of a sear, and a throughbore in communication with said transverse bore, a spring means securable to a longitudinal side of said hammer means for positioning said sear;

a cap means securable to said base member, said cap means having a throughbore;

a plunger element reciprocal from a loaded to an unloaded position, having a first end cooperable with said hammer and said sear and a second end having a glass-engaging tip, said plunger element having an annular flange axially positioned midway along its length, said plunger element having a reset spring positioned below said axial flange and a positioning spring positioned above said axial flange.

2. A combination nightstick/baton rescue punch comprising a standard law enforcement nightstick/baton having an elongate body having a first end and a second end, and having a handle member disposed between said first end and said second end said second end of said elongate body having a rescue punch secured therein, said rescue punch comprising:

a base member engageably secured to said second end of said nightstick/baton, said base member having an axial bore for receipt of a power spring compressibly positioned within said axial bore, a hammer element positionable above said power spring, said hammer element having a transverse bore for receipt of a sear, and a throughbore in communication with said transverse bore, a spring means securable to a longitudinal side of said hammer means for positioning said sear;

a cap means securable to said base member, said cap means having a throughbore;

a plunger element reciprocal from a loaded to an unloaded position, having a first end cooperable with said hammer and said sear and a second end having a glass-engaging tip, said plunger element having an annular flange axially positioned midway along its length, said plunger element having a reset spring positioned below said axial flange and a positioning spring positioned above said axial flange.

* * * * *